US008167547B2

(12) United States Patent
Wu et al.

(10) Patent No.: US 8,167,547 B2
(45) Date of Patent: May 1, 2012

(54) GAS TURBINE ENGINE WITH CANTED POCKET AND CANTED KNIFE EDGE SEAL

(75) Inventors: Charles C. Wu, Glastonbury, CT (US); Kevin N. McCusker, West Hartford, CT (US); Roger E. Paolillo, Vernon, CT (US); Page Russell Palmiter, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 997 days.

(21) Appl. No.: 11/714,019

(22) Filed: Mar. 5, 2007

(65) Prior Publication Data

US 2009/0067997 A1 Mar. 12, 2009

(51) Int. Cl.
*F01D 11/02* (2006.01)

(52) U.S. Cl. ..... 415/173.5; 415/174.5; 277/418

(58) Field of Classification Search ..... 415/173.7, 415/168.2, 171.1, 173.5, 173.6, 174.5, 230; 277/347, 418, 419

See application file for complete search history.

(56) References Cited

U.S. PATENT DOCUMENTS

| | | | | | |
|---|---|---|---|---|---|
| 963,593 | A | * | 7/1910 | Legros | 415/106 |
| 1,482,031 | A | | 1/1924 | Parsons | |
| 1,505,647 | A | | 8/1924 | Junggren | |
| 1,651,855 | A | * | 12/1927 | Warren | 277/413 |
| 1,708,044 | A | * | 4/1929 | Baumann | 277/418 |
| 1,756,958 | A | * | 5/1930 | Schmidt | 415/131 |
| 1,759,058 | A | | 5/1930 | Schmidt | |
| 1,819,864 | A | * | 8/1931 | Bloomberg | 415/168.4 |
| 1,857,961 | A | * | 5/1932 | Lamb | 277/413 |
| 2,910,269 | A | | 10/1959 | Haworth et al. | |
| 3,251,601 | A | * | 5/1966 | Harvey | 277/424 |
| 3,940,153 | A | * | 2/1976 | Stocker | 277/418 |
| 4,190,397 | A | * | 2/1980 | Schilling et al. | 415/112 |
| 4,351,532 | A | * | 9/1982 | Laverty | 277/419 |
| 4,453,722 | A | | 6/1984 | Swanson | |
| 4,477,088 | A | | 10/1984 | Picard | |
| 4,477,089 | A | | 10/1984 | Hoffman | |
| 4,574,619 | A | | 3/1986 | Castellant | |
| 5,161,943 | A | | 11/1992 | Maier | |
| 5,211,535 | A | | 5/1993 | Martin | |
| 5,218,816 | A | * | 6/1993 | Plemmons et al. | 60/806 |
| 5,224,713 | A | | 7/1993 | Pope | |

(Continued)

FOREIGN PATENT DOCUMENTS

EP 1001139 A1 5/2000

(Continued)

OTHER PUBLICATIONS

European Search Report, dated Mar. 25, 2010.

*Primary Examiner* — Edward Look
*Assistant Examiner* — Aaron R Eastman
(74) *Attorney, Agent, or Firm* — Carlson, Gaskey & Olds

(57) ABSTRACT

A gas turbine engine is provided with turbine sealing structures including knife edge seals which extend at an angle relative to an axial center line of the engine. Each knife edge seal is associated with a control pocket defined between a radially inner surface and a spaced radially outer surface. The control pockets and their associated knife edge seals create a difficult flow path to prevent leakage into radially inner portions of the turbine section.

7 Claims, 2 Drawing Sheets

U.S. PATENT DOCUMENTS

| | | | | |
|---|---|---|---|---|
| 5,333,993 | A * | 8/1994 | Stueber et al. | 415/174.5 |
| 5,402,636 | A * | 4/1995 | Mize et al. | 60/806 |
| 5,630,590 | A | 5/1997 | Bouchard | |
| 5,639,095 | A * | 6/1997 | Rhode | 277/303 |
| 5,639,211 | A | 6/1997 | Bintz | |
| 5,899,660 | A * | 5/1999 | Dodd | 415/9 |
| 6,000,701 | A | 12/1999 | Burgess | |
| 6,164,655 | A * | 12/2000 | Bothien et al. | 277/303 |
| 6,644,914 | B2 * | 11/2003 | Lawer et al. | 415/173.4 |
| 6,742,783 | B1 * | 6/2004 | Lawer et al. | 277/416 |
| 7,025,565 | B2 * | 4/2006 | Urso et al. | 415/173.5 |
| 7,241,109 | B2 * | 7/2007 | Ferra | 415/174.5 |
| 7,445,213 | B1 * | 11/2008 | Pelfrey | 277/418 |
| 7,556,474 | B2 * | 7/2009 | Marchi | 415/115 |
| 2001/0031201 | A1 * | 10/2001 | Lawer et al. | 415/173.4 |
| 2005/0047910 | A1 * | 3/2005 | Habedank et al. | 415/173.7 |
| 2007/0059164 | A1 * | 3/2007 | Brault et al. | 415/174.5 |
| 2008/0124215 | A1 * | 5/2008 | Paolillo et al. | 415/173.7 |

FOREIGN PATENT DOCUMENTS

| | | | |
|---|---|---|---|
| EP | 1780380 | A2 | 5/2007 |
| GB | 13004 | A | 0/1907 |
| GB | 111897 | A | 12/1917 |
| GB | 767656 | A | 2/1957 |
| GB | 2042086 | A * | 9/1980 |

* cited by examiner

GAS TURBINE ENGINE WITH CANTED POCKET AND CANTED KNIFE EDGE SEAL

BACKGROUND OF THE INVENTION

This application relates to canted knife edge seals which rotate with a gas turbine rotor, and are associated with canted pockets in a stationary sealing surface.

Gas turbine engines are known, and typically include a series of sections. A fan may deliver air to a compressor section. Air is compressed in the compressor section, and delivered downstream to a combustor. In the combustor, air and fuel are combusted. The products of combustion then pass downstream over turbine rotors. The turbine rotors rotate to create power, and also to drive the fan and compressors.

The turbine rotors typically are provided with a plurality of removable blades. The blades are alternated with stationary vanes. It is desirable to limit leakage of the products of combustion radially inwardly of the turbine blades. Thus, the turbine rotors are provided with knife edge seals which are spaced closely from sealing surfaces on the static members.

Labyrinth seal structures are known. Generally, the sealing surfaces have been formed as cylindrical surfaces at a plurality of different radial distances from an engine centerline. The combination of these different radial distances, and a plurality of associated knife edge blades create a labyrinth path to limit leakage fluid. Even so, some leakage does occur, and it would be desirable to further reduce leakage.

SUMMARY OF THE INVENTION

In a disclosed embodiment of this invention, the generally cylindrical sealing surfaces of the prior art are replaced by canted pockets. The pockets generally are defined between a radially inner surface spaced from a radially outer surface. An angled face connects the inner and outer surfaces.

At the same time, in a disclosed embodiment, knife edge seals are associated with the pockets. The knife edge seals extend at an angle in the same general direction as the angled face. The combination of the canted knife edge seals and the pockets limit leakage.

These and other features of the present invention can be best understood from the following specification and drawings, the following of which is a brief description.

DETAILED DESCRIPTION OF THE PREFERRED EMBODIMENT

Figure 1:
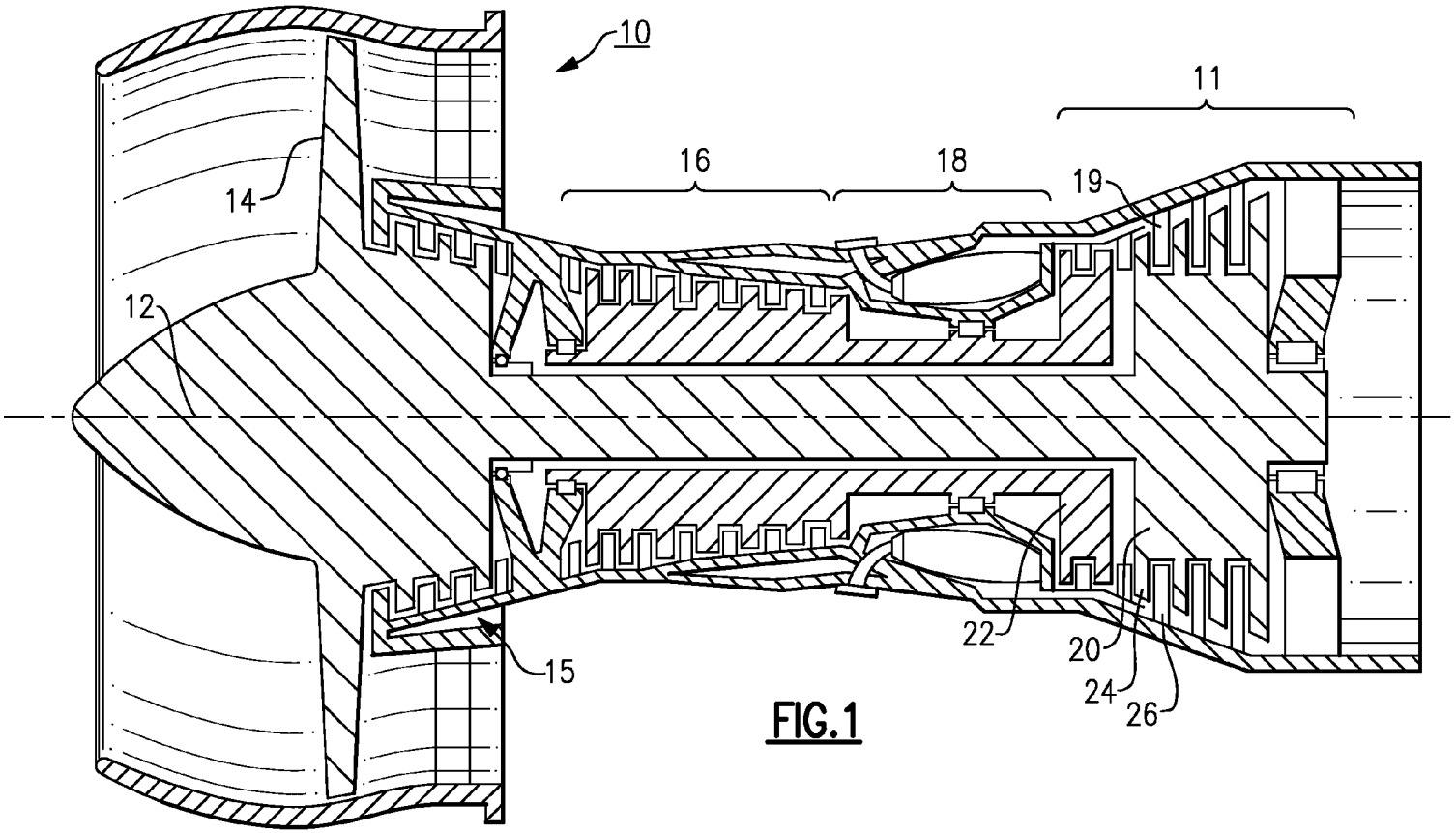
FIG. 1 schematically shows a gas turbine engine.

A gas turbine engine 10, such as a turbofan gas turbine engine, circumferentially disposed about an engine centerline, or axial centerline axis 12 is shown in FIG. 1. The engine 10 includes a fan 14, compressors 15 and 16, a combustion section 18 and turbine sections 20 and 22. As is well known in the art, air compressed in the compressors 15 and 16, and is mixed with fuel and burned in the combustion section 18 and expanded in turbines 20 and 22. The turbines include rotors which rotate in response to the expansion, driving the compressors 15 and 16 and fan 14. The turbines comprise alternating rows of rotary airfoils or blades 24 and static airfoils or vanes 26. In fact, this view is quite schematic, and blades 24 and vanes 26 are actually removable. It should be understood that this view is included simply to provide a basic understanding of the sections in a gas turbine engine, and not to limit the invention. This invention extends to all types of turbine engines for all types of applications.

Figure 2:
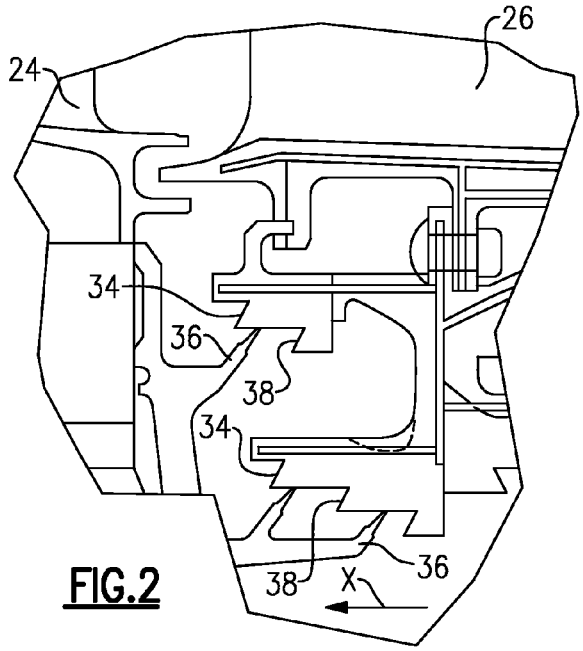
FIG. 2 shows a sample sealing location with a gas turbine engine of the present invention.

FIG. 2 is an enlarged view of turbine blade 24, and stationary vane 26. As known, sealing surfaces 34 are associated with knife edge seals 36. As can be seen in this figure, in the present invention, these knife edge seals extend at an angle relative to the axial centerline 12 of the jet engine. Also, the knife edge seals are associated with canted pockets 38, as will be explained in more detail below. As can be appreciated, there may be a plurality of radially spaced pockets and associated knife edge seals.

Figure 3A:
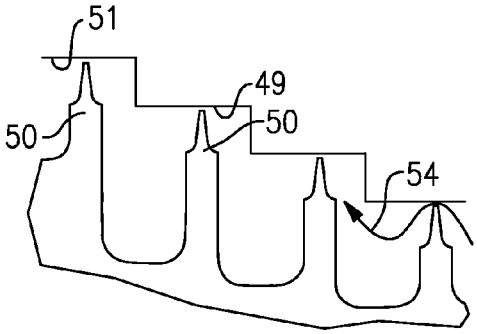
FIG.3A Prior Art
FIG. 3A shows a prior art seal.

As shown in FIG. 3A, in the prior art, a labyrinth seal was created by cylindrical sealing surfaces 49 and 51 spaced at different radial positions, and knife edge seals 50 spaced from the associated static sealing surfaces 51 and 49. As known, an abradable sealing material may actually be positioned at surfaces 49, 51 to allow the knife edge seal to wear the surfaces and provide a close fit. With the radially distinct sealing surfaces 49 and 51, a labyrinth leakage path 54 is presented to any fluid which may leak radially inwardly of the rotor. The labyrinth seal path does provide a good restriction to linkage fluid. However, it would be desirable to even further improve the resistance of this path.

Figure 3B:
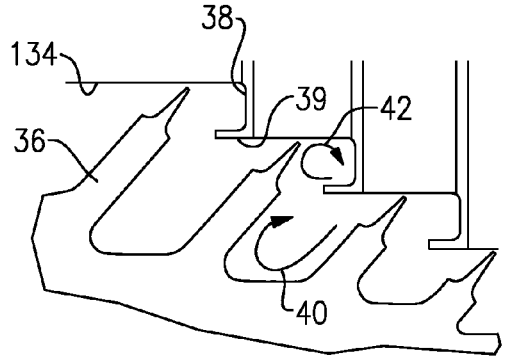
FIG. 3B shows a first sealing arrangement.

Thus, as shown in FIG. 3B, fluid can be forced into vortices 40 and 42 by angling the knife edge seals 36 relative to axis 12 of the gas turbine engine, and creating pockets 38 from radially inner walls 39 and a radially outer wall 134. A vortex 42 is created in the pocket 38, and the angled knife edge seal 36 creates yet another vortex 40. The combination of the vortices 40 and 42 present a great resistance to fluid leakage. This is particularly true when there are additional knife edge seals at different radial positions, and positioned along a path of the fluid flow, as shown in FIG. 3B. In FIG. 3B, the knife edge seals 36 are angled into the pockets 38. This basic arrangement is disclosed in co-pending patent application Ser. No. 11/605,678, entitled "Gas Turbine Engine With Concave Pocket With Knife Edge Seal," filed on 29 Nov. 2006.

Figure 4:
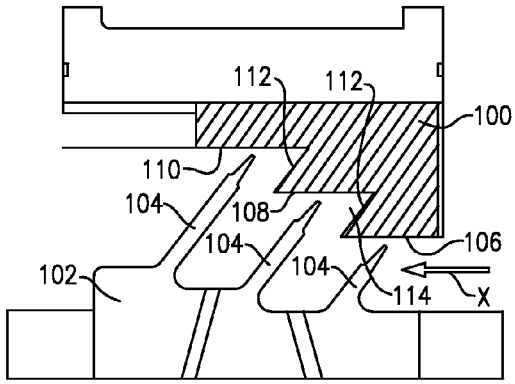
FIG. 4 shows one embodiment of the present invention.

This application relates to an even more restrictive pocket and seal arrangement, one embodiment of which is illustrated in FIG. 4. As shown in FIG. 4, a stationary seal 100 is positioned adjacent to a rotating rotor 102, with the rotor 102 having a plurality of knife edge seals 104 extending at a non-perpendicular angle relative to a flow path of products of combustion across the turbine rotor. As shown, the knife edge seals 104 include a tip 101 and a base 103 that is thicker than the tip 101. The tip 101 is located, and defined, between opposed concave surfaces 101*a*, 101*b*, and a concave pocket 105 is defined by the base 103 and the rotor 102. The shown knife edge seals 104 therefore each include two concave surfaces (e.g., the concave surface 101*a* and the concave pocket 105) along a side 107 thereof facing the direction of flow X. The stationary seal 100 has a plurality of sealing surfaces 106, 108, and 110 associated with the knife edge seals 104. As shown, connecting faces 112 connect the sealing surfaces to define pockets 114. These connecting faces 112 extend at an angle from a radially inner seal portion to a radially outer seal portion, with the angle being into the direction of flow X. Thus, the angle of the surface 112 and the angle of the knife edge seal 104 both extend into the flow direction X, but are non-perpendicular to direction X. The angles selected for the two surfaces may be the same, or they may be selected to be different to achieve various manufacturing and performance goals. Stated another way, the angled surface 112 and the knife edge seals 104 extend in a direction having a component extending in an upstream direction, or toward the combustion section. Now, a very close spacing is provided between the knife edge seals 104 and the sealing surfaces 106, 108, and 110. A more restrictive flow path is presented to prevent fluid from leaking between these surfaces.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A gas turbine engine comprising:

a compressor section;

a combustion section;

a turbine section, said turbine section including at least one rotor for rotation about an axis, said rotor being provided with rotor blades, and said rotor being radially spaced from a static structure, knife edge seals extending close to a sealing surface to provide a seal, and said sealing surfaces having a plurality of sealing pockets associated with at least a plurality of said knife edge seals, said sealing pockets being defined by a radially inner surface spaced from a radially outer surface with said knife edge seals extending along a non-perpendicular angle relative to said axis, and with said sealing pockets being defined to have an angled surface extending between a radially inner sealing surface and a radially outer sealing surface at an angle that is non-perpendicular and non-parallel to said axis;

said knife edge seals being associated with one of said rotor and said static structure, and said sealing surfaces being associated with the other;

said knife edge seals and said angled surfaces are angled along a path towards said combustion section; and said knife edge seals each including a base and a tip, a thickness of said tip being less than a thickness of said base, the tip defined between opposed concave surfaces directly adjacent thereto, wherein a concave pocket is at least partially defined by said base, wherein said concave pocket and one of said opposed concave surfaces provides said knife edge seals with two concave surfaces disposed on a side thereof facing the combustion section.

2. The gas turbine engine as set forth in claim 1, wherein there are a plurality of sealing surfaces on said static structure at distinct radial distances from said axis, and said plurality of sealing surfaces each having an associated sealing pocket with an angled surface, and an associated knife edge seal.

3. The gas turbine engine as set forth in claim 1, wherein said knife edge seals rotate with said rotor.

4. The gas turbine engine as set forth in claim 1, wherein said concave pockets are defined between said base and said one of said rotor and said static structure.

5. A seal for a gas turbine engine comprising:

knife edge seals extending close to a sealing surface to provide a seal, and said sealing surface having sealing pockets associated with at least a plurality of said knife edge seals, said sealing pockets being defined by a radially inner surface spaced from a radially outer surface, with said knife edge seals extending along an angle, and with said sealing pockets being defined to have an angled surface extending between a radially inner sealing surface and a radially outer sealing surface, and wherein one of said knife edge seals and said sealing surfaces is positioned within the other, and will rotate relative to the other when said seal is positioned in a gas turbine engine, said knife edged seals being angled along a path that will face a combustion section when the seal is mounted in an engine, said knife edge seals each including a base and a tip, a thickness of said tip being less than a thickness of said base, the tip defined between opposed concave surfaces directly adjacent thereto, wherein a concave pocket is at least partially defined by said base, wherein said concave pocket and one of said opposed concave surfaces provides said knife edge seals with two concave surfaces disposed on a side thereof facing the combustion section.

6. The seal as set forth in claim 5, wherein there are a plurality of said sealing surfaces at distinct radial distances from an axis of said gas turbine engine, and said plurality of sealing surfaces each having an associated sealing pocket with an angled surface, and an associated knife edge seal.

7. The seal as set forth in claim 5, wherein said knife edge seals are positioned within said sealing surfaces, and said knife edge seals will rotate relative to said sealing surfaces when mounted within said gas turbine engine.

* * * * *